US005411276A

United States Patent [19]

Moldenhauer

[11] Patent Number: 5,411,276

[45] Date of Patent: May 2, 1995

[54] ROLLER SKATE BRAKE

[75] Inventor: Paul G. Moldenhauer, St. Louis Park, Minn.

[73] Assignee: Rollerblade, Inc., Minneapolis, Minn.

[21] Appl. No.: 201,362

[22] Filed: Feb. 24, 1994

[51] Int. Cl.[6] ..... A63C 17/14

[52] U.S. Cl. ..... 280/11.2; 188/25; 188/4 B; 280/11.22

[58] Field of Search ..... 280/11.2, 11.22, 11.23; 188/25, 2 D, 74, 71.1, 71.4, 72.1, 73.2, 4 B

[56] References Cited

U.S. PATENT DOCUMENTS

| | | | |
|---|---|---|---|
| 580,271 | 4/1897 | Godfrey . | |
| 585,328 | 6/1897 | Humphrey et al. | 188/25 |
| 920,848 | 5/1909 | Eubank, Jr. . | |
| 926,646 | 6/1909 | Eubank, Jr. . | |
| 1,501,589 | 10/1923 | Ferris . | |
| 1,687,739 | 3/1927 | Slusher . | |
| 1,801,205 | 5/1930 | Mirick . | |
| 1,933,421 | 2/1933 | Elliotte . | |
| 2,027,487 | 11/1933 | Means . | |
| 4,076,266 | 2/1978 | Krausz . | |
| 4,108,451 | 8/1978 | Scheck, Sr. | 280/11.2 |
| 4,300,781 | 11/1981 | Riggs | 280/11.2 |
| 4,805,936 | 2/1989 | Krantz | 280/842 |
| 4,823,916 | 4/1989 | Shyu | 188/25 X |
| 4,943,075 | 7/1990 | Gates | 280/842 |
| 5,069,462 | 12/1991 | Murga | 280/11.2 X |
| 5,171,032 | 12/1992 | Dettmer | 280/11.2 |

*Primary Examiner*—Margaret A. Focarino
*Assistant Examiner*—Carla Mattix
*Attorney, Agent, or Firm*—Merchant, Gould, Smith, Edell, Welter & Schmidt

[57] ABSTRACT

A roller skate brake for a roller skate having at least two rolling wheels mounted in-line. Each rolling wheel has a circumferential surface and is rotatably mounted to the roller skate about a rolling wheel axle. The brake includes a braking wheel also having a circumferential surface. The braking wheel is rotatably mounted about the roller skate about a braking wheel axle approximately parallel the rolling wheel axle. The braking wheel is mounted to the roller skate so that the circumferential surface of the roller skate wheel can be brought into contact with the circumferential surface of the rolling wheel. The brake also includes a braking lever for braking the rotation of the braking wheel when in contact with the rolling wheel, thus braking the rolling wheel. The circumferential surface of the rolling wheel is generally convex and the circumferential surface of the braking wheel may be generally concave. The braking wheel may have a plurality of ribs disposed on and extending away from the circumferential surface of the braking wheel.

6 Claims, 4 Drawing Sheets

ROLLER SKATE BRAKE

FIELD OF THE INVENTION

The present invention pertains generally to braking mechanisms for roller skates.

BACKGROUND OF THE INVENTION

Roller skating, in particular in-line skating, has become a popular sport and pastime. One of the more difficult aspects of in-line skating is braking and speed control, particularly when descending a hill. Various roller skate brakes have been developed to aid the skater in braking and speed control.

One braking device now in widespread use is a rear braking pad. The pad is disposed downwardly from proximate the heel of the skate. When all the wheels of the skate are in contact with the skating surface, the pad is disposed above the skating surface. In order to apply the pad brake, the skater must lift the toe of the skate and force the pad against the skating surface. This is generally a quite effective means for speed control and braking, however, mastery of the technique is somewhat difficult for beginners and novices.

Another roller skate brake is disclosed in U.S. Pat. No. 926,646 to Eubank, Jr. The Eubank brake includes a roller rotatably attached about an axle connected to a lever. The roller is disposed proximate or adjacent to one of the rolling wheels of the roller skate. The skater supplies force to the lever by way of a strap fastened around the user's leg and operably connected to the lever. This arrangement presents the disadvantage of making braking action dependent upon the rotation of the skater's leg about the ankle, which would appear to result in frequent unintentional braking. Additionally, Eubank does not disclose a means for braking the inevitable rotation of the roller when it is brought in contact with the adjacent rolling wheel.

Another patent, U.S. Pat. No. 4,300,781 to Riggs, discloses a roller skate brake including brake pads which are forced to impinge one each against parallel rolling wheels by way of a sheathed cable and actuator handle similar to a bicycle caliber brake. The brake disclosed by Riggs is for braking wheels having essentially cylindrical circumferential rolling surfaces. The circumferential surfaces of the rolling wheels of most in-line skates, however, generally have a convex or archic cross-section. It is anticipated that the brake pad disclosed by Riggs if applied to typical in-line skate wheels would, through abrasion, tend to truncate or flatten the convex or archic cross-section of those wheels. This would tend to reduce the skates' performance making them more difficult to control.

SUMMARY OF THE INVENTION

The present invention is directed to a roller skate brake overcoming functional limitations of prior roller skate brakes. The present invention provides a roller skate brake which can easily be mastered by beginning skaters and provide consistent braking performance without distorting the desired circumferential cross-section of the rolling wheels through abrasion.

The roller skate brake has two or more rolling wheels, each having a circumferential surface, and each being rotatably mounted to the roller skate about a rolling wheel axle. The brake includes a braking wheel also having a circumferential surface. The braking wheel is rotatably mounted to the roller skate about a braking wheel axle approximately parallel the rolling wheel axle. The braking wheel is mounted to the roller skate so that the circumferential surface of the braking wheel can be brought into contact with the circumferential surface of the rolling wheel. The roller skate brake also includes a brake lever for braking the rotation of the braking wheel and, consequently, the rotation of the rolling wheel.

The circumferential surface of the rolling wheel is generally convexed and the circumferential surface of the braking wheel is generally concave. The braking wheel may have a plurality of ribs disposed on and extending away from the circumferential surface of the braking wheel.

DETAILED DESCRIPTION OF THE PREFERRED EMBODIMENT

Figure 1:
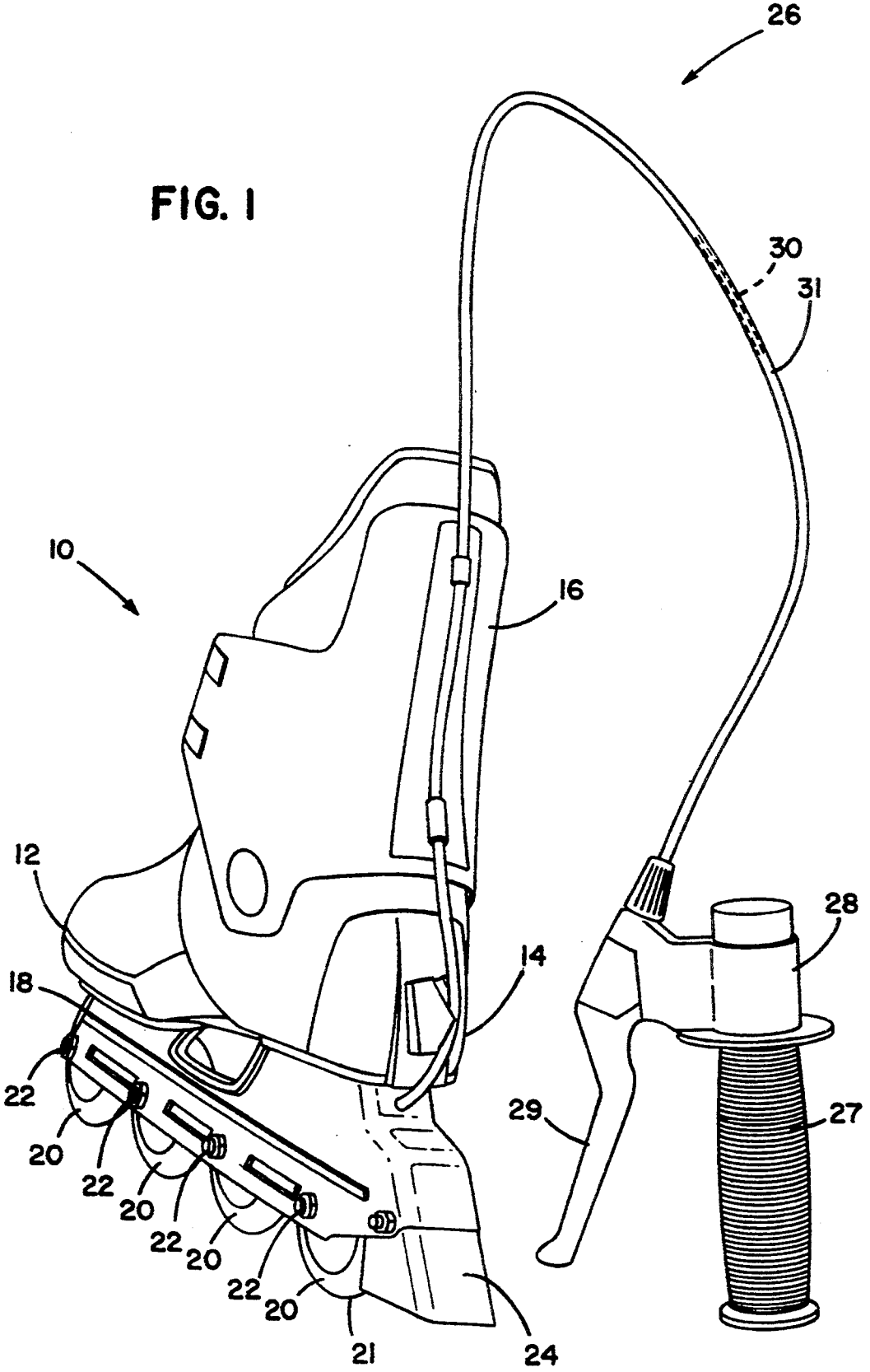
FIG. 1 shows a perspective view of an in-line skate equipped with a roller skate brake.

Referring now to the drawings, wherein like reference numerals designate identical or corresponding parts throughout the several views, FIG. 1 shows a roller skate referred to by the numeral 10. Roller skate 10 has a front 12 and a back 14. Roller skate 10 includes a conventional boot or shoe portion 16 and a supporting member 18. Boot 16 is operably connected to support member 18 to which are rotatably connected a plurality of rolling wheels 20. Operably connected to the back of supporting member 18 is a conventional heel braking pad 24.

Figure 2:
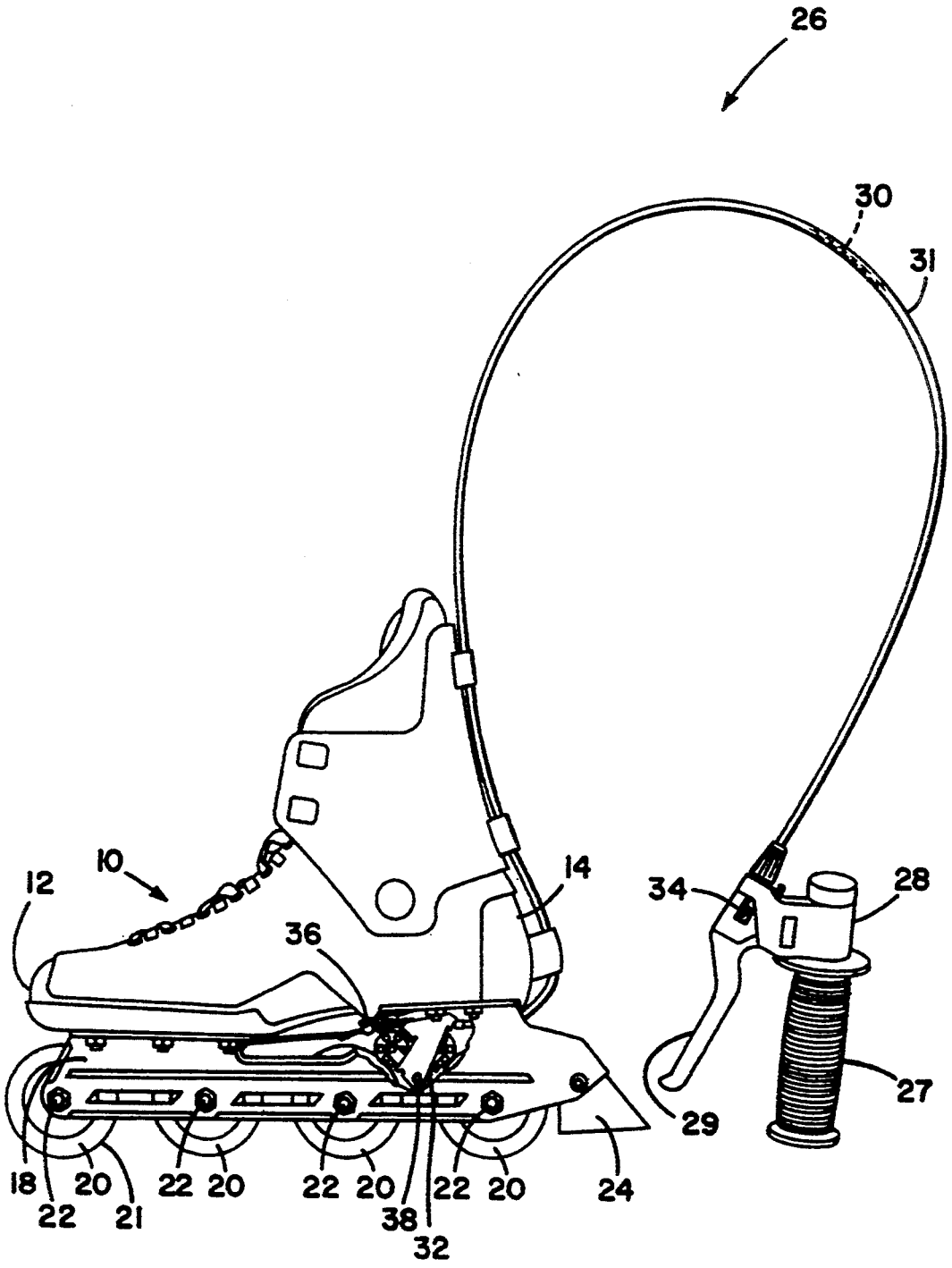
FIG. 2 shows a side and cutaway view of the roller skate equipped with the brake.

As shown in FIGS. 1 and 2, skate 10 is also equipped with a brake 26 including a hand brake lever 28, a cable 30 with a sheath 31, and a braking unit 32. Hand brake lever 28 includes a handle 27 and an oppositely disposed lever portion 29. Cable 30 extends from a first end 34 operably connected to-hand brake lever 28 along back 14 of roller skate 10 to a second end 36 operably connected to braking unit 32.

In the preferred embodiment, the rolling wheels 20 are arranged and operably connected to support member 18 by axles 22 about which wheels 20 rotate. Each wheel 20 has a circumferential surface 21. Preferably surface 21 has an convex archic cross-section shown particularly well in FIG. 5. In the preferred embodiment, wheels 20 are arranged in-line, that is, wheels 20 are mounted for rotation within the same plane.

Braking unit 32 is preferably disposed between two adjacent rolling wheels 20 and is operably connected to support member 18 by a pivot 38 having a longitudinal axis. The longitudinal axis of pivot 38 is approximately parallel to axles 22 of rolling wheels 20. In the preferred embodiment, braking unit 32 is disposed between and upwardly of the rearmost rolling wheels 20.

Figure 3:
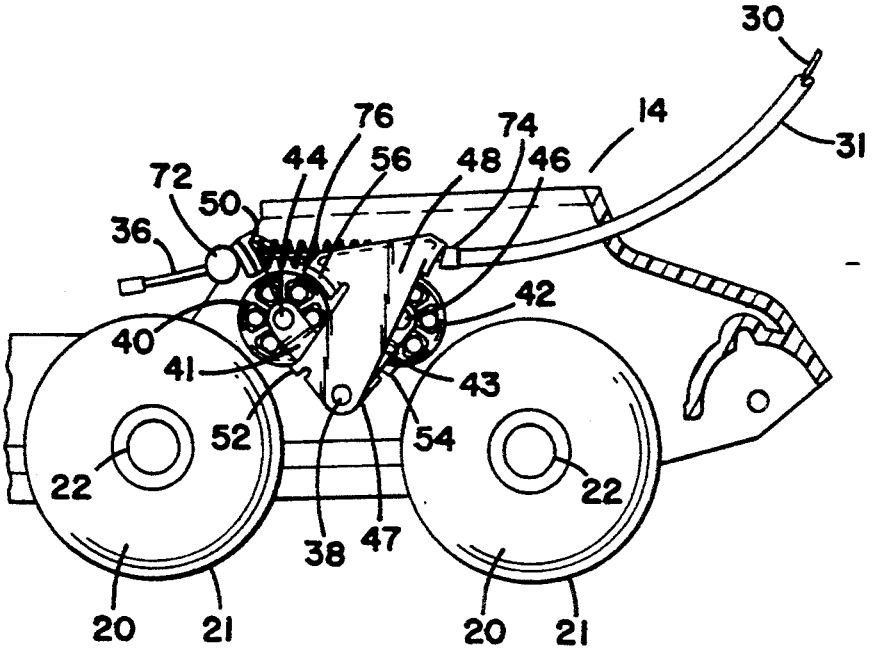
FIG. 3 shows a pair of braking wheels in a first position.
Figure 4:
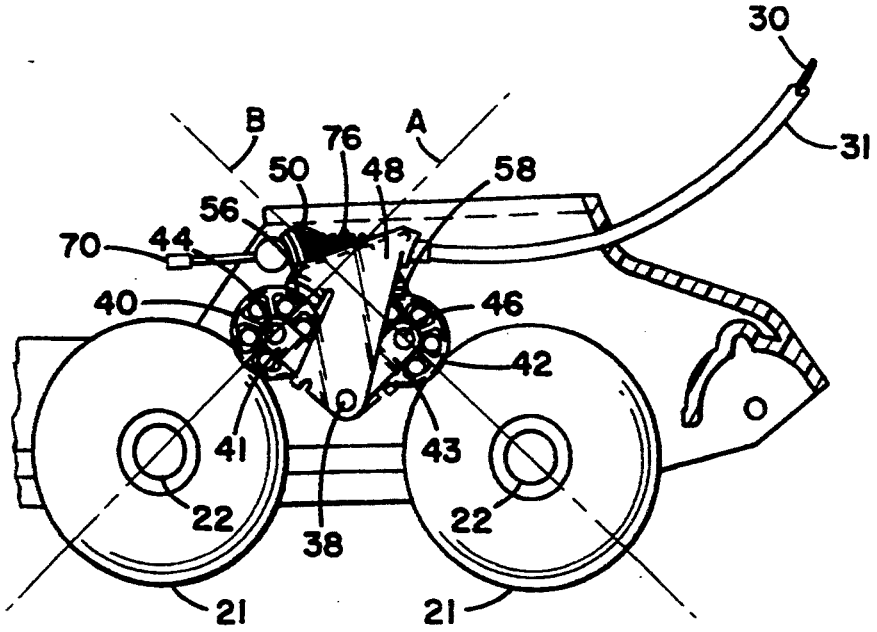
FIG. 4 shows a pair of braking wheels in a second position.
Figure 5:
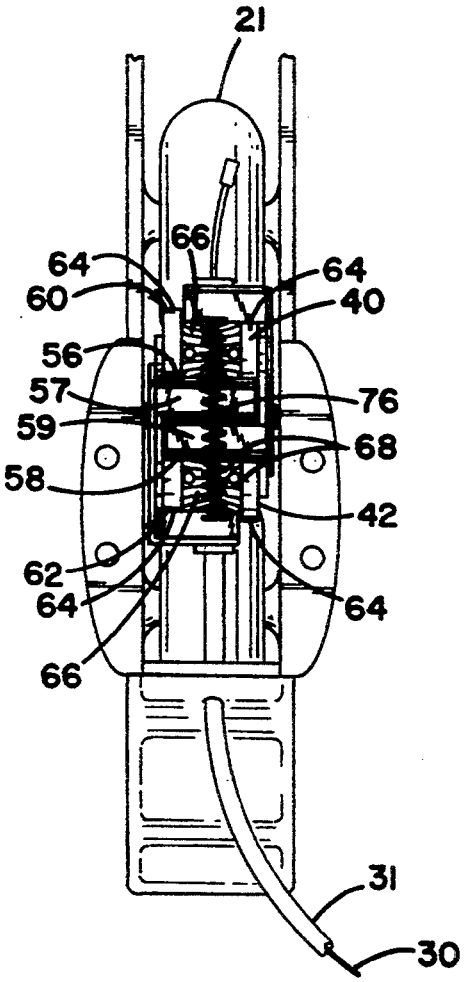
FIG. 5 shows a top view of a braking unit of the roller skate brake.

As shown in FIGS. 3–5, braking unit 32 includes a front braking wheel lever 41 and a back braking wheel lever 43. Each braking wheel lever 41 and 43 has a first and second end. The first ends of wheel levers 41 and 43 are rotatably mounted to pivot 38.

Rotatably mounted proximate the second ends of wheel levers 41 and 43 are braking wheels 40 and 42, respectively. Braking wheels 40 and 42 are mounted for rotation about axles 44 and 46, respectively. Braking wheels 40 and 42 are movable between a first position (shown in FIG. 3) spaced apart from rolling wheels 20 to a second position (shown in FIG. 4) in direct contact with respective rolling wheels 20. The axles 44 and 46 of braking wheels 40 and 42, respectively, are approximately parallel to the axles 22 of rolling wheels 20.

Braking wheels 40 and 42 have outer circumferential surfaces 60 and 62, respectively. The circumferential surfaces 60 and 62 include two spaced-apart generally smooth surfaces 64 which are cylindrical with their axes parallel to the axes 44, 46. Disposed between smooth surfaces 64 of each circumferential surface 60 and 62 is a concave surface 66, the radius of which approximately equals but is slightly greater than the radius of the convex circumferential surface 21 of rolling wheels 20. Generally traversing concave surfaces 66 of braking wheels 40 and 42 are a plurality of ribs 68. Each rib 68 has a sharpened edge disposed outwardly away from axles 44 and 46 of braking wheels 40 and 42, respectively. Braking wheels 40 and 42 are preferably aluminum and hollow. The exterior surface of braking wheels 40 and 42 is preferably hard coated.

Braking unit 32 also includes a braking means 47 for braking the rotation of braking wheels 40 and 42 and moving the braking wheels between the first and the second positions. Braking means 47 includes front braking lever 48 and a back braking lever 50. Each braking lever 48 and 50 has a first end and a second end. The first end of each braking lever 48 and 50 is rotatably mounted to pivot 38.

Proximate the first end of braking lever 48 is a finger 52 disposed between front braking wheel lever 41 and adjacent rolling wheel 20. Back braking lever 50 has a similar finger 54 disposed between back braking wheel lever 43 and adjacent rolling wheel 20. In the preferred embodiment, fingers 52 and 54 are integrally formed with braking levers 48 and 50, respectively.

Proximate the second end of braking levers 48 and 50 are brake pads 56 and 58, respectively. Brake pads 56 and 58 are preferably leather. Brake pads 56 and 58 are mounted on brake pad mounts 57 and 59, respectively, extending from and preferably formed integrally with the second ends of braking levers 48 and 50, respectively. Brake pad mounts 57 and 59 preferably extend across the entire cross sections of front braking wheel 40 and back braking wheel 42, respectively. Brake pads 56 and 58 likewise preferably extend across the entire cross section of braking wheels 40 and 42.

When braking wheels 40 and 42 are in the second position (FIG. 4), front brake pad 56 preferably lies approximately on a line "A" drawn through axle 44 of front braking wheel 40 and axle 22 of proximate rolling wheel 20. Likewise, when braking wheels 40 and 42 are in the second position, rear brake pad 58 preferably lies on a line "B" drawn through axle 46 of rear braking wheel 42 and axle 22 of the proximate rolling wheel 21.

Braking means 47 also includes a drawing means 70 for drawing the second end of front brake lever 48 and the second end of back brake lever 50 toward each other. Drawing means 70 includes second end 36 of sheathed cable 30, wherein sheath 31 extends to and is disposed rearward of the second end of front brake lever 48 and the cable 30 is strung through an opening in the second end of front brake lever 48 and then strung through another opening in the second end of back braking lever 50. There, the unsheathed cable 30 is secured at the second end of back brake lever 50 by an anchor 72, preferably disposed forwardly of the second end of back braking lever 50. Sheath 31 is preferably fitted with a fixture 74 wider than the opening through which the cable 30 is threaded through the second end of front braking lever 48. A biasing means 76, preferably a spring, is disposed about cable 30 between the second end of front braking lever 48 and the second end of back braking lever 50 for biasing the second ends of braking levers 48 and 50 apart. The drawing means may also be considered to include sheathed cable 30 and hand brake lever 28.

In use, roller skate brake 26 can be applied to help a user to stop, slow down, or control the user's speed down hills. To apply brake 26, the user holds hand brake lever 28 and draws lever portion 29 toward handle 27. As well known in the art, this draws cable 30 within sheath 31 toward hand brake lever 28. As cable 30 is drawn through sheath 31 toward hand brake lever 28, second end of front brake lever 48 and second end of back brake lever 50 are drawn toward each other. As the second ends of the brake levers 48 and 50 are drawn toward each other, brake pads 56 and 58 impinge upon surfaces 64 of front braking wheel 40 and back braking wheel 42, respectively. Continued drawing together of the second ends of braking levers 48 and 50 moves braking wheels 40 and 42 toward the second position in contact with proximate rolling wheels 20. Once braking wheels 40 and 42 are in the second position, braking of the proximate rolling wheels 20 begins. Braking of rolling wheels occurs because brake pads 56 and 58 act to brake rotation of braking wheels 40 and 42, respectively. The more force that a user applies drawing lever portion 29 toward handle portion 27 of hand brake lever 28, the more forcefully brake pads 56 and 58 will impinge on braking wheels 40 and 42, respectively, and thus proximate rolling wheels 20.

When the user allows lever portion 29 of hand brake lever 28 to move away from handle portion 27, cable 30 is drawn away from hand brake lever 28 while second ends of braking levers 48 and 50 are biased apart by biasing means 76. As the second ends of braking levers 48 and 50 are biased apart, fingers 52 and 54, respectively, engage front braking wheel lever 41 and back braking wheel lever 43, respectively, to move braking wheels 40 and 42, respectively, toward the first position.

While the present invention has been described in connection with the preferred embodiment thereof, it will be understood many modifications will be readily apparent to those skilled in the art, and this application is intended to cover any adaptations or variations thereof. It is manifestly intended this invention be limited only by the claims and equivalents thereof.

What is claimed is:

1. A roller skate brake for a roller skate, the roller skate having at least a front and a rear rolling wheel, each rolling wheel having a circumferential surface, and being rotatably mounted to the roller skate about a rolling front and a rear rolling wheel axle, respectively, the brake comprising:

a pivot having a longitudinal axis approximately parallel to the rolling wheel axles, the pivot being operably connected to the roller skate between said rolling wheels;

a front and a rear braking wheel lever each having a first end rotatably mounted to the pivot;

a front and a rear braking wheel each having a circumferential surface, the front and rear braking wheels being rotatably mounted to a second end of the front and rear braking wheel levers, respectively, about a front and a rear braking wheel axle approximately parallel the rolling wheel axles; and braking means for rotating the wheel levers about the longitudinal axis of the pivot, so that the front and rear braking wheels move between a first position wherein the circumferential surface of the front and rear braking wheels are spaced apart from the circumferential surface of the front and rear rolling wheels, and a second position wherein the circumferential surface of the front and rear braking wheels are in contact with the circumferential surface of the front and rear rolling wheel, and the braking means brakes the rotation of the front and rear braking wheels when in the second position.

2. A roller skate brake in accordance with claim 1, wherein the rolling wheels have a generally convex circumferential surface and the braking wheels have generally concave circumferential surface.

3. A roller skate brake in accordance with claim 1, wherein the braking wheels have a plurality of ribs disposed on and extending away from the circumferential surface of the braking wheels.

4. A brake for a roller skate having a front and a back, the roller skate having and at least a first and second rolling wheel being mounted in-line, the second behind the first, for rotation about separate approximately parallel axles, the brake comprising:

a pivot having a longitudinal axis approximately parallel the rolling wheel axles, the pivot being disposed between two rolling wheels and being operably connected to the roller skate;

a front brake lever having a first end and a second end, the first end being rotatably mounted to the pivot and the second end having a forwardly disposed braking pad;

a back brake lever having a first end and a second end, the first end being rotatably mounted to the pivot, and the second end having a rearwardly disposed pad and the second end being disposed generally forward of the second end of the front brake lever;

a front wheel lever having a first end and a second end, the first end being rotatably mounted to the pivot;

a back wheel lever having a first end and a second end, the first end being rotatably mounted to the pivot;

a front braking wheel having a circumferential surface, the front braking wheel being rotatably mounted to the second end of the front wheel lever about a braking wheel axle approximately parallel the rolling wheel axle, and the front braking wheel being disposed proximate and between the pad on the front brake lever and the first rolling wheel;

a back braking wheel having a circumferential surface, the back braking wheel being rotatably mounted to the second end of the back wheel lever about a braking wheel axle approximately parallel the rolling wheel axle, and the back braking wheel being disposed proximate and between the pad on the back brake lever and the-second rolling wheel;

drawing means for drawing the second end of the front brake lever and the second end of the back brake lever toward each other so that the front brake lever pad impinges on the front braking wheel rotating the wheel lever about the pivot to move the front braking wheel from a first position spaced apart from the first rolling wheel to a second position wherein the circumferential surface of the front braking wheel is in contact with the circumferential surface of the first rolling wheel, and the back brake lever pad impinges on the back braking wheel rotating the back wheel lever about the pivot to move the back braking wheel from a first position spaced apart from the second rolling wheel to a second position wherein the circumferential surface of the second rolling wheel, and the front brake lever pad brakes the front braking wheel when it is in the second position, and the back brake lever pad brakes the back braking wheel when it is in the second position.

5. A roller skate in accordance with claim 4, wherein the-rolling wheels have a generally convex circumferential surface and the braking wheels have a generally concave circumferential surface.

6. A roller skate brake in accordance with claim 4, wherein at least one of the braking wheels has a plurality of ribs disposed and extending away from the circumferential surface of the braking wheel.

* * * * *